US005150527A

United States Patent [19]

Knoster

[11] Patent Number: 5,150,527

[45] Date of Patent: Sep. 29, 1992

[54] GUN SIGHTING ARBOR

[76] Inventor: Richard G. Knoster, R.D. 2, Box 211, New Paris, Pa. 15554

[21] Appl. No.: 703,373

[22] Filed: May 21, 1991

[51] Int. Cl.[5] ..... F41G 1/54

[52] U.S. Cl. ..... 33/234; 279/2.22

[58] Field of Search ..... 279/2 R, 1 Q; 33/234; 294/93; 242/72 R

[56] References Cited

U.S. PATENT DOCUMENTS

| | | | |
|---|---|---|---|
| 2,542,967 | 2/1951 | Waechter | 279/1 Q |
| 3,228,678 | 1/1966 | Koger | 279/2 R |
| 4,057,905 | 11/1977 | Piaja | 33/234 |
| 4,090,305 | 5/1978 | Cassidy | 33/234 |
| 4,534,116 | 8/1985 | Davis | 279/2 R X |
| 4,750,269 | 6/1988 | Townsend et al. | 279/2 R X |

FOREIGN PATENT DOCUMENTS

| | | | |
|---|---|---|---|
| 1156896 | 3/1958 | France | 279/1 Q |

OTHER PUBLICATIONS

Brownells Catalog No. 43, 1990-1991.

*Primary Examiner*—Larry I. Schwartz
*Assistant Examiner*—Robert Schultz
*Attorney, Agent, or Firm*—Webb, Burden, Ziesenheim & Webb

[57] ABSTRACT

An expandable arbor for sighting a scope on a gun having a body with a conical portion and an axial throughbore. A shaft is journaled in the throughbore, and the shaft carries a knob on one end and a resilient plug on the other end, with a travelling spreader disk on a threaded portion of the shaft adjacent the plug. The plug is inserted into the muzzle of a gun barrel, and the knob is tightened to draw the spreader disk into the plug, thereby causing the plug to expand to hold the arbor in the gun barrel and concentrically align the arbor within the bore. The arbor has a flat on a rear portion for receiving a set screw to mount a bore sighter on the arbor for aligning the scope on the gun.

15 Claims, 1 Drawing Sheet

GUN SIGHTING ARBOR

BACKGROUND OF THE INVENTION

1. Field of the Invention

The invention relates generally to a device for securing a sighting instrument within the bore of a firearm and, more particularly, to an expandable arbor.

2. Description of the Prior Art

Hunting has become increasingly dangerous in recent years, not only for hunters but for people who live and work in suburban areas. With the encroachment of suburbia into former farmlands and woodlands, several states have passed laws limiting the use of weapons and ammunition during certain hunting seasons, particularly deer hunting season. Basically, these laws prohibit the use of high-caliber rifles and require the hunter to use shotguns with slug ammunition only. High-caliber rifles are capable of firing bullets as far as seven miles whereas a shotgun slug will travel a maximum of about 640 yards. Thus, the danger to communities which border on hunting areas is greatly reduced with use of slug ammunition.

This evolution in hunting has created a need for more accurate shotguns. In slug-only jurisdictions, hunters normally mount a scope on the shotgun, and the scope is adjusted for elevation and windage to match the firing characteristics of the particular shotgun on which it is mounted. To accomplish this adjustment, the hunter typically uses a collimator, or "bore sighter", which is mounted on the end of the barrel using an arbor. The arbor is inserted into the bore of the barrel at the muzzle, and it is critical that the arbor be mounted concentrically within the bore to ensure that the scope is properly adjusted.

U.S. Pat. No. 4,057,905 discloses a device for securing a sighting instrument within a shotgun bore. This device has a main shaft 16 which carries a fixed seat 32 on one end with a spring-loaded muzzle stopper 22 on the other. The muzzle stopper has three ball bearing rods 28 extending therefrom, with a ball bearing 30 on the end of each rod 28. The ball bearings are inserted in the muzzle to find the true concentricity of the bore, and the main shaft 16 extends through the muzzle stopper 22 to serve as a means for mounting a collimator thereto. This arrangement has several problems. First, the ball bearings are likely made from steel, which could be harmful to the bore of the barrel, especially if it is rifled. Second, the ball bearing rods 28 must be manufactured and mounted within a very low tolerance to ensure that they are equal in length. A slight deviation in length between one rod and the other can significantly alter the concentricity of the device within the bore. The spring, ball bearing and reciprocating shaft arrangements are complicated and expensive to manufacture. Finally, the spring-loaded main shaft reduces the overall strength of the device and limits the weight of the collimator which is mounted on the main shaft.

Other expandable arbors have been marketed, including Bushnell Model No. 4D10V65 with shotgun adaptor Model No. 9512G30. Similarly, B-Square markets a shotgun bore sighter under Model No. 1BOOSSS. These arbors utilize rubber O-rings as bearing contacts for the shotgun bore. The O-rings are easily damaged when the arbor is compressed into a rifled shotgun barrel or a removable choke tube barrel. Once the O-ring is cut or scratched in any way, it will not project the true concentricity of the bore, therefore causing improper adjustment of the scope.

To date, there are no expandable arbors for use with black powder rifles and shotguns having bore sizes ranging from 0.490 to 0.800 inch.

It is therefore an object of the present invention to provide an arbor which will accommodate a wide range of bore sizes, including those for black powder rifle barrels, shotgun barrels and choke tubes. It is a further object to provide an inexpensive expandable arbor which is not easily damaged in use and which offers maximum accuracy in finding the true bore axis.

SUMMARY OF THE INVENTION

The invention is an arbor for securing a sighting device to a firearm having a barrel with a muzzle. The arbor has a body with a front portion, a conical portion, a rear portion and an axial throughbore. A shaft is journaled in the throughbore, and the shaft carries a knob on one end adjacent to the rear portion of the body. The shaft has a threaded portion on the other end.

A resilient plug is slideably carried on the shaft adjacent the front portion of the body, and the plug has a radially expandable rim on its end opposite the front portion of the body. A travelling spreader disk is carried on the shaft adjacent the plug, and an end nut is carried on the threaded end of the shaft. Means are provided on the rear portion of the body for securing a sighting device to the arbor.

The plug and the front portion of the body are received by the barrel, while the conical portion of the body engages the muzzle. The knob may be rotated clockwise to draw the spreader disk toward the body, thereby expanding the plug and to secure it concentrically within the barrel.

In a preferred embodiment of the invention, the arbor includes a recessed plug seat at the front end of the body for receiving the plug, and the plug seat includes a transverse bearing face with a tapered wall extending outwardly therefrom. The plug is substantially cylindrical and the end opposite the expandable rim is tapered. The taper on the plug engages the tapered wall of the plug seat. The spreader disk has a conical face which engages the end of the plug near the expandable rim.

The rear portion of the body preferably has a conical recess for receiving a corresponding conical face on the knob. The means for securing the sighting device to the arbor preferably includes a flat on the rear portion of the body for receiving a set screw when the sighting device is in place.

Further details and advantages of the present invention will become apparent from the following description and the accompanying drawings.

DESCRIPTION OF THE PREFERRED EMBODIMENT

Figure 1:
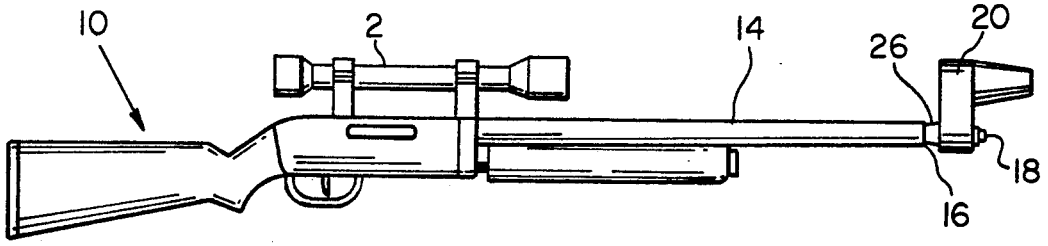
FIG. 1 is a side view of a shotgun having an arbor inserted in its barrel in accordance with the present invention.

FIG. 1 of the drawings shows a shotgun 10 having a barrel 14 and a scope 12. The barrel 14 has a muzzle 16, and an arbor 18 according to the present invention is mounted therein. The arbor 18 carries a collimator 20, also known as a "bore sighter", for adjusting the scope 12.

Figure 2:
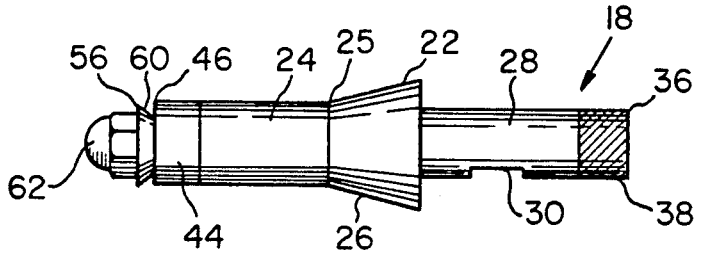
FIG. 2 is a side view of the arbor of FIG. 1.
Figure 3:
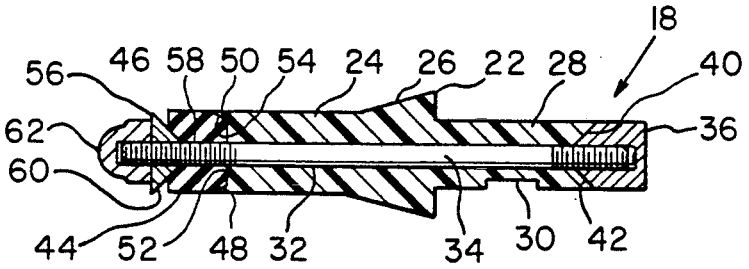
FIG. 3 is a longitudinal section through the arbor.

Referring to FIGS. 2 and 3 of the drawings, the arbor 18 has a body 22 including a substantially cylindrical front portion 24, a conical portion 26 and a substantially cylindrical rear portion 28. The rear portion 28 has a smaller diameter than the remainder of body 22, and a machined or molded flat 30 is located on rear portion 28 for receiving a set screw to secure the collimator 20 to the arbor. The body 22 is made from an annealed nylon, and the joint 25 between front portion 24 and conical portion 26 should be ground as smooth as possible to facilitate insertion of body 22 into the muzzle of barrel 14.

The body 22 also has a machined axial throughbore 32. A shaft 34 is journaled in throughbore 32 and may be freely rotated therein. A knob 36 is threaded on a first threaded end of shaft 34 and may be torqued to prevent accidental loosening and disconnection thereof. Shaft 34 and knob 36 are fashioned from aluminum, and the knob may include a plurality of knurls 38 on its outer cylindrical surface to assist in gripping. Knob 36 also has a conical hub 40 which is received by a corresponding knob seat 42 formed in the end of rear portion 28 of body 22. Knob seat 42 is preferably conical to correspond with conical hub 40 on knob 36.

A cylindrical resilient plug 44 is carried on an end of the shaft 34 opposite knob 36, adjacent the front end of portion 24 of body 22. The plug 44 may be made from silicone or latex rubber, and it has a radially expandable rim 46 at the end opposite front portion 24. A tapered rim 48 is on the end of the plug opposite expandable rim 46, and the tapered rim is received in a plug seat 50 in front portion 24 of body 22. Plug seat 50 has a transverse bearing face 52 with a tapered annular wall 54 extending therefrom. The tapered rim 48 on plug 44 engages tapered wall 54 when the plug is received by plug seat 50.

A travelling spreader disk 56 is carried on a threaded end 58 of shaft 34 opposite knob 36. The spreader disk 56 has receiving threads which engage threaded portion 58, and it has a conical face 60 directed toward plug 44. Spreader disk 56 may be made from aluminum. Finally, an end nut 62 is torqued on threaded portion 58 on the end of shaft 34 opposite knob 36.

Arbor 18 has the following preferred dimensions:

Length of front portion 24=0.900 inch
Length of conical portion 26=0.800 inch
Length of rear portion 28=0.950 inch
Diameter of axial throughbore 32=0.200 inch
Diameter of front portion 24=0.490 inch
Maximum diameter of conical portion 26=0.800 inch
Diameter of rear portion 28=0.500 inch
Depth of knob seat 42=0.160 inch
Depth of plug seat 50=0.125 inch
Angle of taper for tapered rim 48 on plug 44=22.5°
Diameter of plug 44=0.490 inch
Length of plug 44=0.50 inch In use, arbor 18 is first inserted into the muzzle 16 of barrel 14, plug end first. The user then grips rear portion 28 and tightens knob 36 by rotating clockwise until finger-tight. Rotation of knob 36 spins threaded portion 58, thus causing spreader disk 56 to travel in the direction of plug 44 with conical face 60 engaging the end of plug 44 near the expandable rim 46. As knob 36 is further tightened, conical face 60 spreads expandable rim 46 in a concentric manner until it firmly engages the wall of the bore of barrel 14. The various conical surfaces on arbor 18, including hub 40, recess 42, conical portion 26 and face 60, engage one another so that arbor 18 self-aligns to find the exact concentricity of the bore.

Once arbor 18 is secured, the collimator 20 may be mounted on rear portion 28 with its set screw engaging flat 30. Collimator 20 is then twisted to align it with the vertical cross hair in scope 12, and the scope is then adjusted in the normal manner. To remove the arbor, knob 36 is loosened, relieving the compression of plug 44 between spreader disk 56 and plug seat 50, thereby allowing the plug to return to its original shape.

My arbor is generally useful for firearms having bore sizes ranging from 0.490–0.800 inch. This includes 10 gauge, 12 gauge and 16 gauge shotguns as well as black powder rifles, or "muzzle loaders", as small as 0.50 caliber. The arbor is useful with virtually all commercial collimators, with the possible exception of that marketed by Redfield. The arbor is also useful with various choke tubes which are placed in the shotgun muzzle to facilitate use of slug ammunition.

The plug 44 and conical portion 26 provide a greater bearing surface within the bore of barrel 14 than prior art arbors, therefore reducing the chance for misalignment due to application of forces on the extended rear portion 28 of the arbor. The durable plastic and polymer construction of arbor 18 increases the useful life of the arbor, and these materials will not harm the interior of polished or rifled barrels. Additionally, the use of non-ferrous metal, such as aluminum, to fashion the end nut, spreader disk, shaft and knob increases the compatibility of the arbor with rifled or polished barrels as aluminum will not harm these surfaces. The various conical surfaces on arbor 18 interact to self-align the arbor within the bore, thus finding true concentricity and assuring maximum accuracy in adjusting scope 12. Finally, the arbor 18 is relatively simple and inexpensive to manufacture, providing savings to the user while giving maximum performance.

Having described the presently preferred embodiment of the present invention, it will be understood that it is not intended to limit the invention except within the scope of the appended claims.

I claim:

1. An arbor for securing a sighting device to a firearm having a barrel with a muzzle, said arbor comprising:

a body having a front portion, a conical intermediate portion, rear portion and an axial throughbore;

a shaft having a first end and a second end journaled in said throughbore and having a threaded portion at each end;

a knob threaded on said first end of said shaft adjacent said rear portion of said body;

a resilient plug slideably carried on said shaft adjacent said front portion of said body, said plug having a radially expandable rim on an end opposite said front portion;

a recessed plug seat formed in the front portion of said body for receiving said plug;

a travelling spreader disk carried on the threaded portion of said shaft adjacent said plug;

an end nut threaded on said second end of said shaft; and means on said rear portion of said body for securing a sighting device to said arbor;

wherein said plug and said front portion are received by the barrel, said conical portion engages the muzzle, and said knob may be rotated to draw said spreader disk toward said body to expand said plug and secure said arbor concentrically within the barrel.

2. The arbor of claim 1 wherein said plug seat includes a transverse bearing face with a tapered wall extending outwardly therefrom.

3. The arbor of claim 2 wherein said plug is substantially cylindrical and a taper is formed on the end of said plug opposite from said expandable rim, said taper engaging the tapered wall in said plug seat.

4. The arbor of claim 1 wherein said spreader disk has a conical surface which engages the end of said plug near said expandable rim.

5. The arbor of claim 1 wherein said rear portion of said body has a smaller diameter than the remainder of said body.

6. The arbor of claim 1 including a knob seat formed in the rear portion of said body for receiving an end of said knob.

7. The arbor of claim 6 wherein said knob seat includes a conical recess.

8. The arbor of claim 7 wherein said knob has a conical hub which engages said conical recess.

9. The arbor of claim 1 wherein said means on said body for securing the sighting device to said arbor includes a flat on said rear portion of said body for receiving a set screw.

10. An arbor for securing a sighting device to a firearm having a barrel with a muzzle, said arbor comprising:

a body having a front portion, a conical intermediate portion, a rear portion and an elongated axial throughbore;

a shaft journaled in said throughbore;

a knob on a first end of said shaft adjacent said rear portion of said body;

a threaded portion on a second end of said shaft opposite said first end;

a knob seat formed in said rear portion of said body for receiving said knob;

a resilient plug slideably carried on said shaft adjacent said front portion of said body, said plug having a radially expandable rim;

a recessed plug seat formed in said front portion of said body for receiving a portion of said resilient plug;

a travelling spreader disk carried on said threaded portion of said shaft adjacent said plug, said spreader disk having a conical surface which engages the end of said plug opposite said plug seat;

an end nut carried on the second end of said shaft; and means on said rear portion of said body for securing the sighting device to said arbor;

wherein said plug and said front portion of said body are received by the barrel, said conical portion engages the muzzle, and said knob may be rotated to draw said spreader disk toward said body, thereby expanding said plug and securing said arbor concentrically within the barrel.

11. The arbor of claim 10 wherein said knob seat includes a conical recess.

12. The arbor of claim 11 wherein said knob has a conical hub which engages said conical recess.

13. The arbor of, claim 10 wherein said plug seat includes a transverse bearing surface and a tapered wall extending outwardly from said bearing surface.

14. The arbor of claim 13 wherein said plug is cylindrical and has a taper on the end opposite said expandable rim, said taper engaging said tapered wall in said plug seat.

15. An arbor for securing a sighting device to a firearm having a barrel with a muzzle, said arbor comprising:

a body having a front portion, a conical portion, a rear portion and an elongated axial throughbore;

a shaft journaled in said throughbore and carrying a knob with a conical hub on a first end of said shaft adjacent said rear portion of said body, said shaft having a threaded portion on the end opposite said first end;

a conical knob seat formed in said rear portion of said body for receiving said conical hub of said knob;

a resilient cylindrical plug slideably carried on said shaft adjacent said front portion of said body, said plug having a radially expandable rim on one end and a taper on an opposite end;

a recessed plug seat in said formed in said front portion of said body for receiving said plug, said plug seat having a transverse bearing surface with a tapered wall extending outwardly therefrom, whereby said taper on said plug engages said tapered wall in said plug seat;

a travelling spreader disk carried on said threaded portion of said shaft adjacent said plug, said spreader disk having a conical surface which engages the end of said plug near said expandable rim;

an end nut carried on the second end of said shaft; and means on said rear portion of said body for securing the sighting device to said arbor;

wherein said plug and said front portion of said body are received by the barrel, said conical portion engages the muzzle, and said knob may be rotated to draw said spreader disk toward said body, thereby expanding said plug and securing said arbor concentrically within the barrel.

* * * * *